US006745733B2

(12) United States Patent
Hendriksma

(10) Patent No.: US 6,745,733 B2
(45) Date of Patent: Jun. 8, 2004

(54) ACTUATING SYSTEM FOR MODE-SWITCHING ROCKER ARM DEVICE

(75) Inventor: Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/080,236

(22) Filed: Feb. 21, 2002

(65) Prior Publication Data

US 2003/0154941 A1 Aug. 21, 2003

(51) Int. Cl.[7] ..... F01L 1/34

(52) U.S. Cl. ..... 123/90.16; 123/90.39; 74/569

(58) Field of Search ..... 123/90.16, 90.17, 123/90.42, 90.39, 90.4, 90.41, 90.43, 90.44, 90.45, 90.46, 90.47; 74/53, 54, 55, 567, 405, 470, 510, 569

(56) References Cited

U.S. PATENT DOCUMENTS 4,223,703 A * 9/1980 Pfarrwaller ..... 139/145
4,583,473 A * 4/1986 Ebata ..... 112/465
4,711,207 A * 12/1987 Bonvallet ..... 123/198 F
4,726,332 A * 2/1988 Nishimura et al. ..... 123/90.16
5,394,841 A * 3/1995 Murakami ..... 123/90.15
5,431,133 A * 7/1995 Spath et al. ..... 123/90.16
5,544,626 A * 8/1996 Diggs et al. ..... 123/90.16
5,653,198 A 8/1997 Diggs

* cited by examiner

*Primary Examiner*—Thomas Denion
*Assistant Examiner*—Jaime Corrigan
(74) *Attorney, Agent, or Firm*—Patrick M. Griffin

(57) ABSTRACT

An actuating system for a mode-switching rocker arm device includes an elongate actuator shaft having a central axis that is parallel with and spaced apart from a central axis of an engine camshaft. An actuator lever extends in a generally radial direction from the actuator shaft to engage a locking pin of the rocker arm device. A cam follower engages and is pivotally oscillated relative to the central axis of the actuator shaft by an actuator cam lobe of the engine camshaft. A clutch/brake assembly is associated with the actuator shaft and the cam follower. The clutch/brake assembly is operable to selectively transfer pivotal oscillation of the cam follower to pivotal movement of the actuator shaft and actuator lever to thereby translate the locking pin and cause the rocker arm device to switch mode.

23 Claims, 3 Drawing Sheets

ACTUATING SYSTEM FOR MODE-SWITCHING ROCKER ARM DEVICE

TECHNICAL FIELD

The present invention relates to an actuating system for a mode-switching rocker arm device of an internal combustion engine.

BACKGROUND OF THE INVENTION

Many modern internal combustion engines provide for the selective deactivation of one or more engine valves under predetermined engine operating conditions, such as, for example, during periods wherein demand for engine power is relatively low, to improve fuel economy. Two-step valve actuation, wherein the valves are actuated according to a selected one of a high-lift and a low-lift profile, is similarly used in many modern internal combustion engines. Various devices, generally referred to hereinafter as mode-switching rocker arm devices, are used to achieve valve deactivation and/or two-step valve actuation. Those devices typically require one or more associated actuating devices that enable switching between modes of operation.

In order to accommodate the actuating devices, a specially designed engine cylinder head is likely to be required. Further, such actuating devices are typically operated by fluid/hydraulic pressure. Thus, the actuating devices are relatively slow in operation, and fluid passageways and connections must be provided. The slow operation of the switching/actuating devices can also render the timing and/or sequence of the mode switching event unpredictable. If, when deactivating cylinders, the mode-switching event occurs in the wrong sequence rough engine operation can result. If the mode switching event occurs during the time period when the valve lift event is commencing or about to commence, the mode-switching device may suffer permanent damage or emit undesirable noise (i.e., pin ejection).

Therefore, what is needed in the art is an actuating system that does not require redesign of engine cylinder heads.

Furthermore, what is needed in the art is an actuating system that is operated by the engine camshaft rather than by fluid pressure and thus responds relatively quickly.

Still further, what is needed in the art is an actuating system that does not require associated fluid passageways and/or connections.

Moreover, what is needed in the art is an actuation system that increases the predictability of the mode-switching event and reduces the potential of damage to the mode-switching device.

SUMMARY OF THE INVENTION

The present invention provides an actuating system for a mode-switching rocker arm device of an internal combustion engine.

The invention comprises, in one form thereof, an elongate actuator shaft having a central axis that is parallel with and spaced apart from a central axis of an engine camshaft. An actuator lever extends in a generally radial direction from the actuator shaft to engage a locking pin of the rocker arm device. A cam follower engages and is pivotally oscillated relative to the central axis of the actuator shaft by an actuator cam lobe of the engine camshaft. A clutch/brake assembly is associated with the actuator shaft and the cam follower. The clutch/brake assembly is operable to selectively transfer pivotal oscillation of the cam follower to pivotal movement of the actuator shaft and actuator lever to thereby translate the locking pin and cause the rocker arm device to switch modes.

An advantage of the present invention is the need to redesign engine cylinder heads is substantially reduced and/or eliminated.

A further advantage of the present invention is the actuating system is operated by and in timed relation to the engine camshaft, and therefore responds relatively quickly.

A still further advantage of the present invention is the need for associated fluid passageways and/or connections is substantially reduced and/or eliminated.

An even further advantage of the present invention is that it increases the predictability of the actuation event and the mode-switching event.

Yet another advantage of the present invention is that it reduces the potential for damage (i.e., pin ejection) to the mode-switching device.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
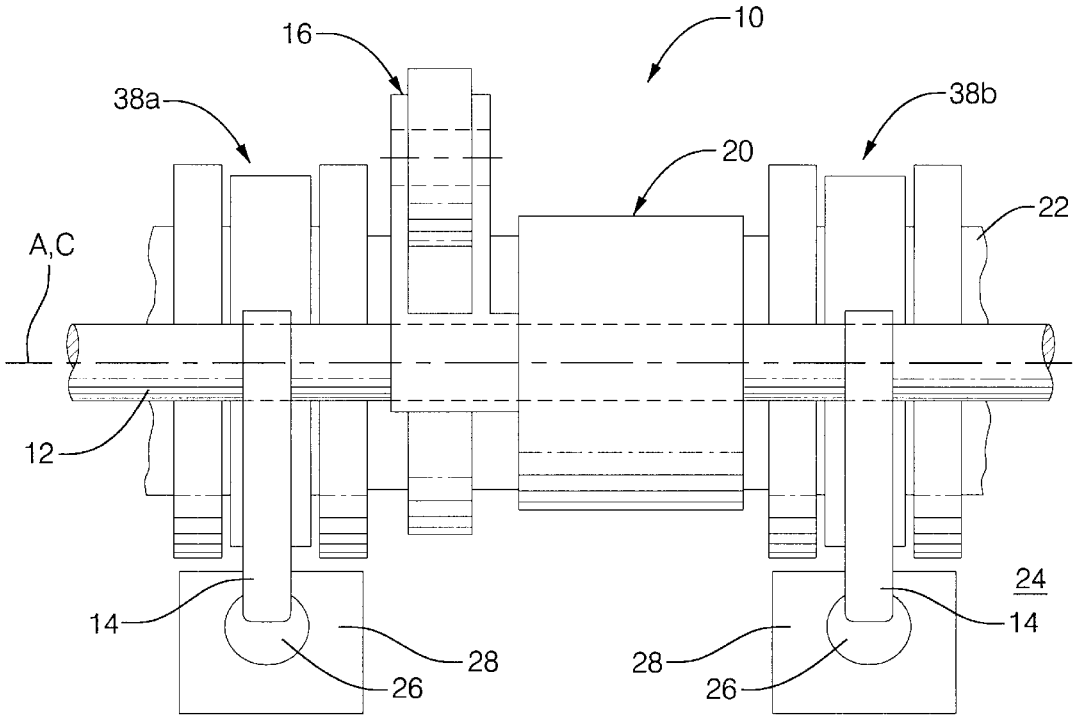
FIG. 1 is a perspective view of one embodiment of the actuating system of the present invention.
Figure 2:
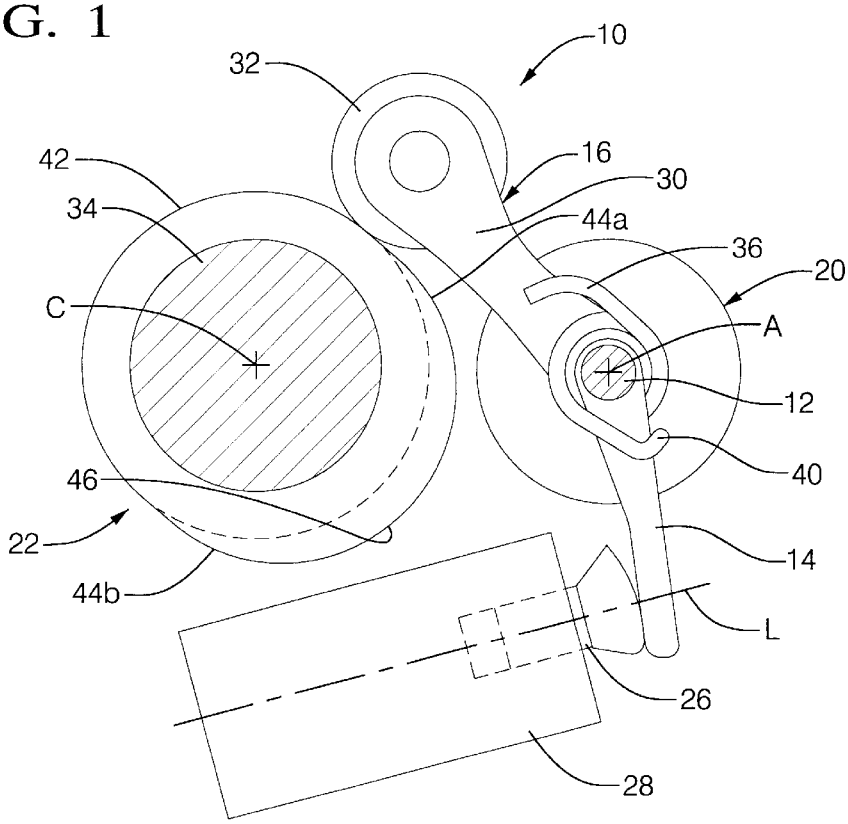
FIG. 2 is a side view of the actuating system of FIG. 1.

Referring now to the drawings, and particularly to FIGS. 1 and 2, there is shown one embodiment of the actuating system of the present invention. Actuating system 10 includes actuator shaft 12, actuator lever 14, cam follower 16 and clutch/brake assembly 20. As is described more particularly hereinafter, actuating system 10 is operably associated with rotary camshaft 22 of engine 24.

Actuator shaft 12 is an elongate shaft member having central axis A. Central axis A is spaced apart from and substantially parallel relative to central axis C of camshaft 22. Actuator shaft 12 is coupled to clutch/brake assembly 20, as will be described more particularly hereinafter.

Actuator lever 14, as best shown in FIG. 2, is an elongate lever member that extends in a generally radial direction from actuator shaft 12. A first end of actuator lever 14 is pivotally coupled, such as, for example, via a bushing (not shown), to actuator shaft 12. A second end of actuator lever 14 is associated with, such as, for example, in abutting engagement with and/or disposed in close proximity to, locking pin 26 of mode-switching rocker arm device 28, such as, for example, a deactivation or two-step roller finger follower. One example of such a mode-switching rocker arm device, i.e., a deactivation roller finger follower, is described in U.S. Pat. No. 5,653,198, the disclosure of which is hereby incorporated by reference herein. Actuator lever 14 is biased to a default orientation with respect to shaft 12 by, for example, a torsion spring (not shown).

Cam follower 16 is operably associated with clutch/brake assembly 20 and with camshaft 22. More particularly, cam follower 16 includes cam follower arm 30 having a first end (not referenced) that carries roller 32. Roller 32 engages actuator cam lobe 34 of camshaft 22. A second end of cam follower arm 30 is associated with, such as, for example, coupled to clutch/brake assembly 20. The rotation of camshaft 22 and, thus, of actuator cam lobe 34 pivots roller 32 relative to central axis A and thereby pivotally oscillates roller 32 in a generally radial direction toward and away from central axis C. Thus, since roller 32 is carried by cam follower arm 30, the rotation of camshaft 22 pivotally oscillates cam follower 16 relative to central axis A in a direction toward and away from central axis C. The second end of cam follower arm 30 is coupled to clutch/brake assembly 20, and serves as an input thereto. As actuator cam lobe 34 rotates from its high lift position back toward and into the base circle portion, return spring 36 (shown in FIG. 2 only) biases roller 32 into and maintains roller 32 in engagement with actuator cam lobe 34.

Clutch/brake assembly 20 is operably associated with actuator shaft 12. As is explained more particularly hereinafter, clutch brake assembly 20 selectively transfers the pivotal oscillation of cam follower 16 to pivotal oscillation of actuator shaft 12 and, thus, to pivotal movement of actuator lever 14 relative to central axis A. As such, cam follower 16 is the input to and actuator shaft 12 is the output of clutch/brake assembly 20. As will be explained more particularly hereinafter, clutch/brake assembly 20 includes a clutch interfacing cam follower 16 and actuator shaft 12, and a brake between actuator shaft 12 and ground.

Camshaft 22 is driven to rotate by, for example, a crankshaft (not shown) of engine 24. Camshaft 22 includes tri-lobe cams 38*a*, 38*b* (FIG. 1) that are affixed to and/or integral with camshaft 22. Each of which includes two outer or lower-lift cam lobes and a central or high-lift cam lobe (not referenced). Tri-lobe cams 38*a*, 38*b* are each associated with a corresponding rocker arm device 28, such as, for example, a two-step roller finger follower. It is to be understood, however, that camshaft 22 can be alternately configured for use with other types of mode-switching rocker arm devices, such as, for example, a deactivation roller finger follower. In this alternate configuration, the outer or lower-lift cam lobes of tri-lobe cams 38*a*, 38*b* are either completely eliminated or replaced with zero lift cam lobes.

Actuator cam lobe 34 is affixed to and/or integral with camshaft 22. Actuator cam lobe 34 has a lift profile that includes base circle portion 42 (FIGS. 2 and 3), lift/return portions 44*a*, 44*b*, and dwell portion 46 connecting and continuous with lift/return portions 44*a*, 44*b*.

In use, actuating system 10 generally operates to selectively translate locking pin 26 between a first or default position and a second position to thereby switch the operating mode of rocker arm device 28. Camshaft 22, as described above, is driven to rotate by, for example, an engine crankshaft. Camshaft 22 and actuator cam lobe 34 rotate as substantially one body, and thus the rotation of camshaft 22 results in the rotation of actuator cam lobe 34. Actuator cam lobe 34 is engaged by roller 32 which, in turn, is carried by cam follower arm 30. Thus, rotation of actuator cam lobe 34 is transferred via roller 32 to pivotal oscillation of cam follower 16 relative to central axis A of actuator shaft 12.

Figure 3A:
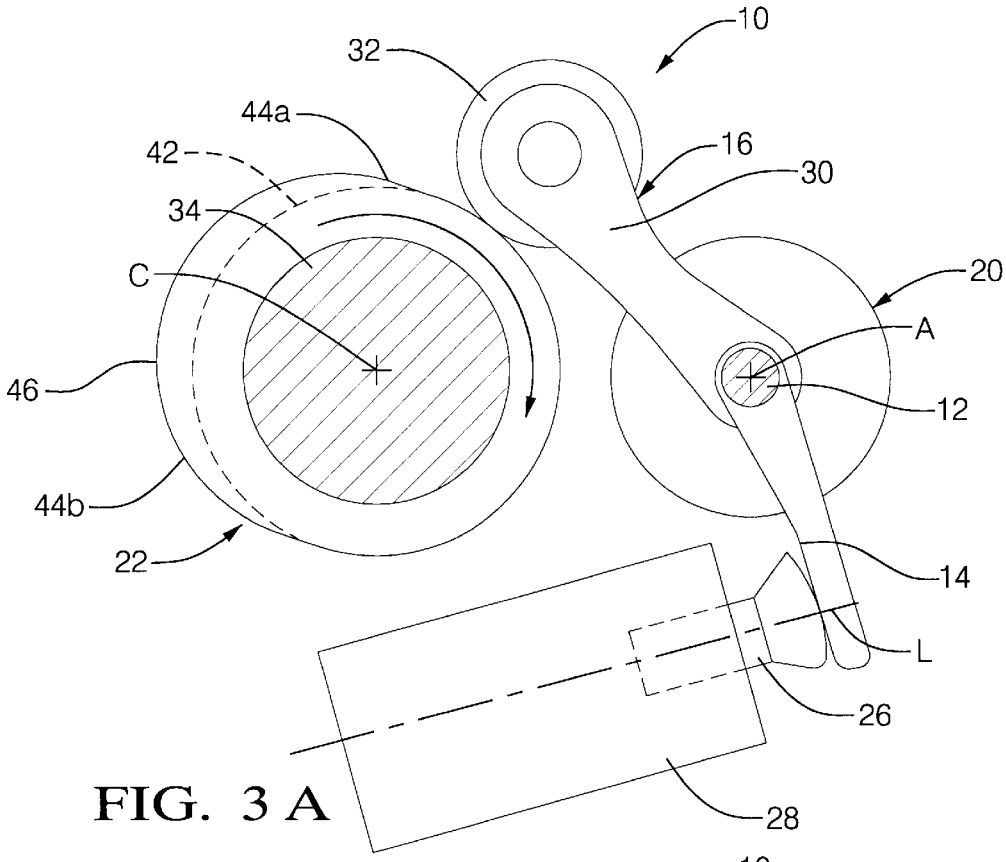
FIG. 3A is a side view of the actuating system of FIG. 1 in a default or de-energized condition and with the locking pin of the associated mode-switching rocker arm device also in the default position.

Referring now to FIG. 3A, actuating system 10 is shown in the default or de-energized condition wherein clutch/brake assembly 20 is de-energized, i.e., neither the clutch or brake engaged, and locking pin 26 in the extended/default position. Thus, the associated rocker arm device 28 is also in its default mode of operation, such as, for example, an activated or high-lift mode. With clutch/brake assembly 20 de-energized, the clutch is not engaged and the pivotal oscillation of cam follower 16 is not transferred to pivotal movement of actuator shaft 12 nor to actuator lever 14.

The mode of operation of rocker arm device 28 is switched from the default mode to the non-default or second mode of operation by translating locking pin 26 from its extended/default position along axis L in an inward direction relative to rocker arm device 28. More particularly, and with reference to FIG. 3A, clutch/brake assembly 20 is energized to engage the clutch during the time that base circle portion 42 of actuator cam lobe 34 is in engagement with roller 32. The relative velocity between actuator shaft 12 and cam follower 16 is substantially zero while roller 32 is engaged by base circle portion 42, thereby providing controlled and smooth engagement of the clutch of clutch/brake assembly 20 with actuator shaft 12. With the clutch of clutch/brake assembly 20 engaged/energized, the pivotal oscillation of cam follower 16 is transferred thereby to pivotal movement of actuator shaft 12 relative to central axis A thereof. Pivotal movement of actuator shaft 12 is, in turn, transferred to pivotal motion of actuator lever 14 relative to central axis A.

It should be particularly noted that due to the construction and method of operation of mode-switching rocker arm device 28, locking pin 26 cannot be depressed when the valve associated therewith is open. However, the pivotal coupling of shaft 12 to actuator lever 14 enables shaft 12 to pivot despite the fact that locking pin 26 cannot be depressed and, therefore, actuator lever 14 can not pivot relative to central axis A. Torsion spring 40 is disposed around shaft 12 and engages lever 14. As shaft 12 pivots without a corresponding pivotal movement of actuator lever 14, torsion spring 40 is wound to thereby exert a greater force upon lever 14. Thus, when the valve associated with mode-switching rocker arm device 28 closes thereby enabling locking pin 26 to be depressed, the force applied by torsion spring 40 upon lever 14 pivots lever 14 in a clock-wise direction relative to central axis A thereby depressing locking pin 26.

Figure 3B:
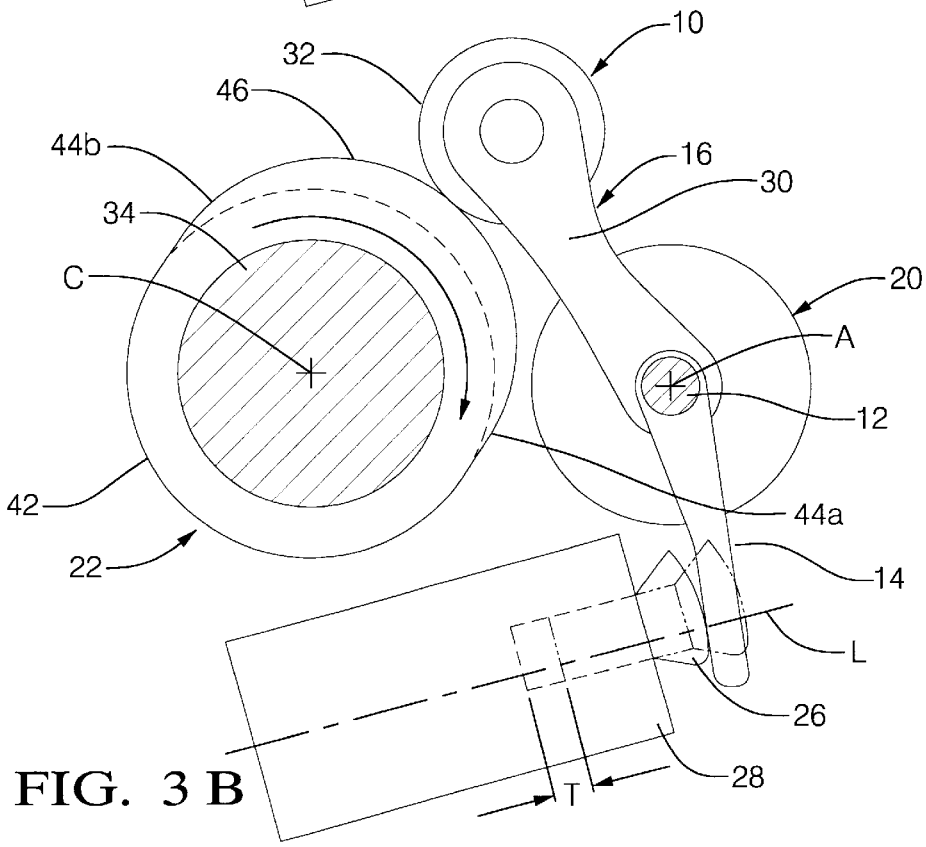
FIG. 3B is a side view of the actuating system of FIG. 1 that illustrates the actuation of the locking pin to thereby switch the operational mode of the associated mode-switching rocker arm device.
Figure 3C:
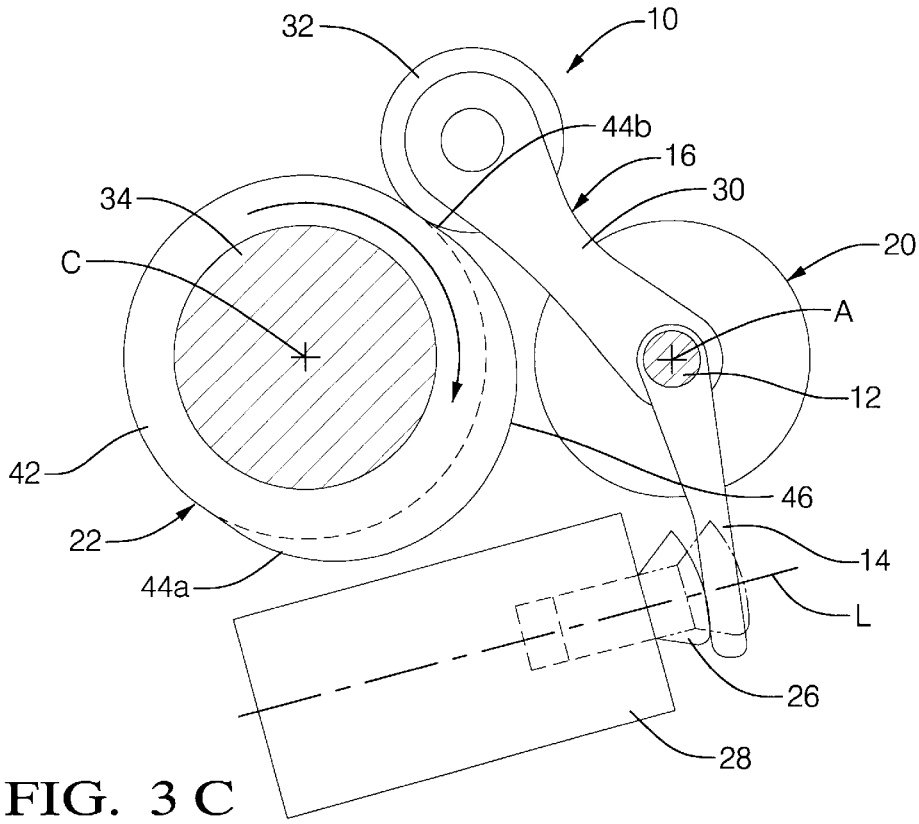
FIG. 3C is a side view of the actuating system of FIG. 1 held in the actuated condition to thereby retain the associated mode-switching rocker arm device in the non-default operating mode.

As shown in FIG. 3B, with the clutch of clutch/brake assembly 20 engaged, rotation of actuator cam lobe 34 from base circle portion 42 through lift portion 44*a* and to dwell section 46 pivots actuator lever 14 from its default position (shown in FIG. 3A) to a pivoted position. The pivoting of actuator lever 14, in turn, translates locking pin 26 inward relative to rocker arm device 28 and along axis L, indicated by pin travel T, to a non-default or non-extended position. With roller 32 engaged by dwell section 46 of actuator cam lobe 34, the clutch of clutch/brake assembly 20 is disengaged/de-energized and the brake is energized/ engaged. With the clutch disengaged, the pivotal oscillation of cam follower 16 is not transferred to actuator shaft 12. Further, with the brake energized/engaged actuator lever 14 is retained in its pivoted position. Thus, as best shown in FIG. 3C, locking pin 26 is retained in its non-default/non-extended position by the retention of actuator lever 14 in its pivoted position as camshaft 22 and actuator cam lobe 34 continues to rotate. Thus, rocker arm device 28 is placed into and held in the non-default or second mode of operation, such as, for example, a deactivated or low-lift mode.

Returning actuator lever 14 to its default position (as shown in FIG. 3A) returns rocker arm device 28 to the default mode of operation. Actuator lever 14 is returned to its default position by disengaging/de-energizing the brake of clutch/brake assembly 20 and maintaining the clutch in the disengaged condition. With the brake and clutch of clutch/brake assembly 20 disengaged/de-energized, a return spring (not shown), such as, for example, a torsion spring, biases actuator lever 14 back to the default/starting position. Alternatively, actuator lever 14 is pivoted back to the default/starting position by a biasing means (not shown), such as, for example, a return spring, of rocker arm device 28 that normally biases locking pin 26 along axis L and in an outward direction relative to rocker arm device 28.

Figure 4:
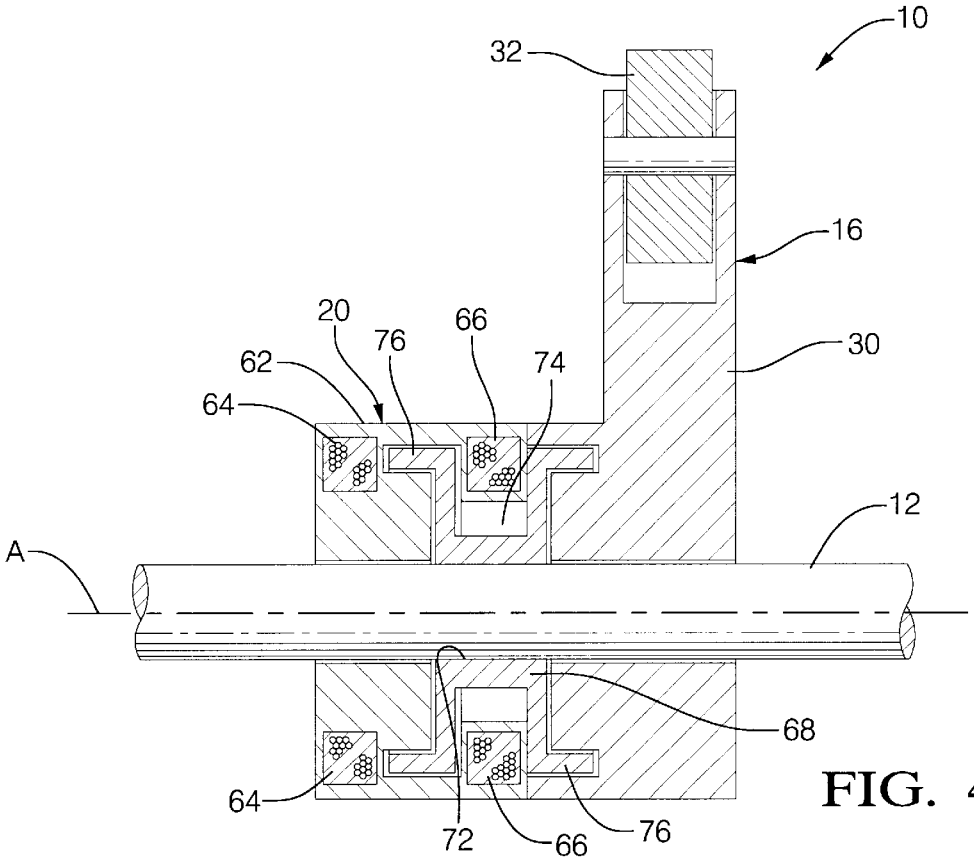
FIG. 4 is a cross sectional view of one embodiment of a clutch/brake assembly for use in the actuating system of FIG. 1.

Referring now to FIG. 4, a cross-sectional view of clutch/brake assembly 20 is shown. Clutch brake assembly 20 includes housing 62, brake coil 64, clutch coil 66, and rotor 68. Housing 62 contains each of brake coil 64 and clutch coil 66. Rotor 68 is disposed partially within housing 62, with a second portion of rotor 68 being disposed external relative to housing 62 and being associated with cam follower arm 30.

Brake coil 64 is contained within and/or enclosed by housing 62, and is disposed in relatively close proximity to the side (not referenced) of rotor 68 that is most distant from cam follower arm 30. Clutch coil 66 is also disposed within housing 62, and between the outer ends of rotor 68 in relatively close proximity to cam follower arm 30.

Rotor 68 is associated with, such as, for example, affixed to or integral with, actuator shaft 12. Rotor 68 includes a central bore 72 that receives actuator shaft 12, which extends through bore 72 and on either side of rotor 68. Rotor 68 also defines central groove 74 and peripheral flanges 76. Clutch coil 66 is disposed at least partially within central groove 74. One of the peripheral flanges 76 is disposed at least partially within corresponding grooves or channels (not referenced) formed in cam follower arm 30, and the other of peripheral flanges 76 is disposed in close proximity to brake coil 64 in corresponding grooves formed in housing 62.

In use, brake and clutch coil 64, 66, respectively, are each electrically connected to a source of electrical energy, such as, for example, a battery, and selectively energized and de-energized as discussed above.

In the embodiment shown, actuating system 10 is configured for use with a deactivation roller finger follower. However, it is to be understood that actuating system 10 is suitable for use with variously configured mode-switching rocker arm devices, such as, for example, deactivation and/or two-step roller finger followers that are switched between operational modes through the depression/release of an associated locking pin.

In the embodiment shown, actuating system 10 is configured with cam follower 16 including cam follower arm 30 having a first end (not referenced) that carries roller 32. Roller 32 engages actuator cam lobe 34 of camshaft 22. However, it is to be understood that actuating system 10 can be alternately configured, such as, for example, with a sliding member carried by or integrally formed with the cam follower arm that slidingly engages the actuator cam lobe.

In the embodiment shown, actuating system 10 is configured for use with mode-switching devices that have locking pins that are extended in the default position and which are depressed by the actuating system. However, it is to be understood that the present invention can be alternately configured for use with mode-switching devices having locking pins that are depressed in the default state and allowed to extended therefrom. The addition of a torsion spring of a sufficient size to bias shaft 12 to depress all locking pins is an exemplary embodiment of such an alternate configuration. In such an alternate configuration, the cam follower is placed on the opposite side of the cam lobe relative to its placement in actuating system 10, and shaft 12 pivots in the opposite direction (counter-clockwise) from its direction of pivot in actuating system 10 when the clutch is energized, thereby allowing the locking pins to extend.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. An actuating system for use with at least one mode-switching rocker arm device of an internal combustion engine, said at least one rocker arm device having a locking pin, said engine having a camshaft with a camshaft central axis, said actuating system comprising:

an elongate actuator shaft having a central axis, said central axis being substantially parallel relative to and spaced apart from the camshaft central axis;

at least one actuator lever, said at least one actuator lever being pivotally coupled to said actuator shaft and extending therefrom in a generally radial direction, each said at least one actuator lever being one of in engagement with and disposed proximate to a corresponding said locking pin;

a cam follower configured for being pivotally oscillated relative to said central axis of said actuator shaft by an actuator cam lobe of the engine camshaft; and a clutch/brake assembly associated with said actuator shaft and said cam follower, said clutch/brake assembly being operable to selectively transfer pivotal oscillation of said cam follower to pivotal movement of said at least one actuator lever to thereby translate each said locking pin.

2. An actuating system for use with at least one mode-switching rocker arm device of an internal combustion engine, said at least one rocker arm device having a locking pin, said engine having a camshaft with a camshaft central axis, said actuating system comprising:

an elongate actuator shaft having a central axis, said central axis being substantially parallel relative to and spaced apart from the camshaft central axis;

at least one actuator lever, said at least one actuator lever being pivotally coupled to said actuator shaft and extending therefrom in a generally radial direction, each said at least one actuator lever being one of in engagement with and disposed proximate to a corresponding said locking pin;

a cam follower configured for being pivotally oscillated relative to said central axis of said actuator shaft by an actuator cam lobe of the engine camshaft; and a clutch/brake assembly associated with said actuator shaft and said cam follower, said clutch/brake assembly being operable to selectively transfer pivotal oscillation of said cam follower to pivotal movement of said actuator shaft and said at least one actuator lever to thereby translate each said locking pin.

3. The actuating assembly of claim 1, wherein said cam follower comprises a cam follower arm having a first end and a second end, a roller carried by said first end, said second end being coupled to said clutch/brake assembly.

4. The actuating assembly of claim 1, wherein said rocker arm device comprises a deactivation roller finger follower.

5. The actuating assembly of claim 1, wherein said rocker arm device comprises a two-step roller finger follower.

6. The actuating assembly of claim 1, wherein said actuating cam lobe includes a base circle portion, a lift portion, a dwell portion, and a return portion, said clutch/brake assembly selectively transferring pivotal oscillation of said cam follower to pivotal movement of said actuator shaft when said cam follower is engaged by one of said dwell portion and said base circle portion.

7. The actuating assembly of claim 1, further comprising a rotor, said rotor being one of affixed to and integral with said actuator shaft, said clutch/brake assembly being associated with said rotor and thereby said actuator cam shaft.

8. The actuating assembly of claim 7, wherein said clutch brake assembly further comprises a housing, a clutch coil and a brake coil, said housing at least partially enclosing said rotor, said rotor defining a central groove and peripheral flanges disposed on opposite sides of said rotor, said clutch coil being disposed at least partially within said central groove.

9. The actuating assembly of claim 8, wherein a first of said peripheral flanges is disposed at least partially within corresponding grooves defined by said housing and proximate to said brake coil, a second of said peripheral flanges being disposed at least partially external to said housing and within corresponding grooves defined by said cam follower.

10. An internal combustion engine, comprising:

a camshaft having a camshaft central axis, at least one cam lobe and at least one actuator cam lobe;

at least one mode-switching rocker arm device, each said at least one rocker arm device operably associated with a corresponding one of said at least one cam lobe, each mode-switching rocker arm device including a respective locking pin;

an elongate actuator shaft having a central axis that is substantially parallel relative to and spaced apart from said camshaft central axis;

at least one actuator lever, said at least one actuator lever being pivotally coupled to said actuator shaft and extending therefrom in a generally radial direction, each said actuator lever being one of in engagement with and disposed proximate to a corresponding said locking pin;

a cam follower in engagement with said actuator cam lobe; and a clutch/brake assembly associated with said actuator shaft and said cam follower, said clutch/brake assembly being operable to selectively transfer pivotal oscillation of said cam follower to pivotal movement of said actuator shaft and said at least one actuator lever to thereby translate each said locking pin.

11. The internal combustion engine of claim 10, wherein said cam follower comprises a cam follower arm having a first end and a second end, a roller carried by said first end, said second end being coupled to said clutch/brake assembly.

12. The internal combustion engine of claim 10, wherein said rocker arm device comprises a deactivation roller finger follower.

13. The internal combustion engine of claim 10, wherein said rocker arm device comprises a two-step roller finger follower.

14. The internal combustion engine of claim 10, wherein said at least one cam lobe comprises a tri-lobed cam.

15. The internal combustion engine of claim 10, wherein said actuating cam lobe includes a base circle portion, a lift portion, a dwell portion, and a return portion, said clutch/brake assembly selectively transferring pivotal oscillation of said cam follower to pivotal movement of said actuator shaft when said cam follower is engaged by one of said dwell portion and said base circle portion.

16. The internal combustion engine of claim 10, further comprising a rotor, said rotor being one of affixed to and integral with said actuator shaft, said clutch/brake assembly being associated with said rotor and thereby said actuator cam shaft.

17. A method of actuating at least one mode-switching rocker arm device, each said at least one mode-switching rocker arm device having a respective locking pin, whereby translation of said locking pin causes said rocker arm device to switch operational modes, said method comprising:

coupling a clutch/brake assembly to a first end of an actuator cam follower, a roller carried by a second end of said actuator cam follower engaging an actuator cam lobe, rotation of said actuator cam lobe causing pivotal oscillation of said actuator cam follower;

further coupling said clutch brake assembly to an actuator shaft; and selectively energizing said clutch/brake assembly such that pivotal oscillation of said actuator cam follower is transferred to pivotal movement of said actuator shaft and to at least one actuator lever affixed thereto relative to a central axis of said actuator shaft to thereby translate said actuator lever from a default position to a pivoted position and said locking pin from a default position to a translated position.

18. The method of claim 17, wherein said selectively energizing step occurs when a roller of said actuator cam follower is in engagement with one of a base circle portion and a dwell portion of said actuator cam lobe.

19. The method of claim 18, wherein said selectively energizing step comprises energizing a clutch coil of said clutch/brake assembly, said clutch coil coupling together said cam follower and said actuator shaft.

20. The method of claim 18, comprising the further step of continuing to energize said clutch/brake assembly such that said at least one actuator lever is retained in said pivoted position to thereby retain said locking pin in said default position.

21. The method of claim 17, comprising the further step of selectively de-energizing said clutch/brake assembly to thereby decouple said cam follower and said actuator shaft.

22. The method of claim 21, wherein said selectively de-energizing step comprises de-energizing a clutch and energizing a brake of said clutch brake assembly, said clutch de-coupling said cam follower and said actuator shaft, said brake retaining said actuator lever in said pivoted position.

23. The method of claim 21, wherein said selectively de-energizing step occurs when a roller of said actuator cam follower is in engagement with one of a base circle portion and a dwell portion of said actuator cam lobe.

* * * * *